United States Patent [19]

Davis et al.

[11] 4,345,424

[45] Aug. 24, 1982

[54] TEXTURED NOVELTY YARN AND PROCESS

[75] Inventors: Michael A. Davis; Bron W. Spivey, both of Asheville, N.C.

[73] Assignee: Akzona Incorporated, Asheville, N.C.

[21] Appl. No.: 161,848

[22] Filed: Jun. 23, 1980

[51] Int. Cl.[3] ..... D02G 3/34

[52] U.S. Cl. ..... 57/209; 28/271; 57/206; 57/207; 57/208; 57/6; 57/350; 57/908

[58] Field of Search ..... 57/6, 91, 207-209, 57/282, 289, 351, 908; 28/252, 271, 226, 163

[56] References Cited

U.S. PATENT DOCUMENTS

| | | | |
|---|---|---|---|
| 3,438,194 | 4/1969 | Cerutti et al. | 57/91 X |
| 3,640,064 | 2/1972 | Palm et al. | 57/91 X |
| 3,654,677 | 4/1972 | Binford et al. . | |
| 4,010,601 | 3/1977 | Anahora et al. | 57/91 X |
| 4,058,968 | 11/1977 | Benson | 57/208 X |
| 4,112,561 | 9/1978 | Norris et al. | 57/91 X |
| 4,159,619 | 7/1979 | Griset | 57/209 X |
| 4,196,574 | 4/1980 | Rhash | 57/208 X |
| 4,212,152 | 7/1980 | Roman | 57/208 |

*Primary Examiner*—Donald Watkins
*Attorney, Agent, or Firm*—Francis W. Young; Tom R. Vestal

[57] ABSTRACT

An effect yarn and process for manufacture thereof is disclosed when the effect comprises a slub that is formed after the yarn leaves the yarn package during later knitting or weaving operations. The effect yarn is particularly useful since it processes through such operations similar to conventional air-plied yarns.

6 Claims, 6 Drawing Figures

TEXTURED NOVELTY YARN AND PROCESS

BACKGROUND OF THE INVENTION

It is known from U.S. Pat. No. 3,812,668, for example, to manufacture yarn from continuous filaments which will have a slub effect along the length of the yarn. Two ends of yarn are fed, one at a greater relative velocity, through a turbulence chamber into which a gas is injected to intermingle the filaments of the two ends together. Described therein are two techniques for forming the slub with the yarn end fed at a greater relative velocity—by allowing the gas to be injected into the chamber in the direction opposite the yarn travel, and by overfeeding the yarn end by means of a fluid jet prior to intertanglement with a second jet device.

While the techniques discussed above are said to produce tension-stable, slub-effect yarns, the present invention has advantages in processing performance and economics.

BRIEF DESCRIPTION OF THE INVENTION

The present invention is to an effect yarn that has the handling ease of normal tangle-plied yarns but produces a slub effect when woven or knitted into fabric. The effect yarn of the invention may also be made on conventional processing machinery utilizing end yarns that are simultaneously processed and textured.

The effect yarn herein is manufactured by combining two ends of textured yarn at approximately the same speed through an air tangling jet. One end is periodically tensioned relative to the second end. Of course, it may be possible to alter the effect through the combination of more than two ends, but the present discussion will be limited to two.

Of particular advantage is the manufacture of the effect yarn herein on conventional falsetwist texturing machines. The initial yarns may be undrawn, fully drawn or partially drawn and further drawn and textured in accordance with conventional practice. Also, while not so limited, the two yarns are preferably of opposite twist.

While certain effects may be obtained through the use of variable draw ratios, filament cross sections and filament counts, the more striking and effective variations may be found by using yarns of differing dyeability. This latter effect may be accomplished most readily through polymer modification or the use of different polymer-based yarns. Any fiber-forming polymer capable of being textured may be used.

In the present invention, the effect yarn in package form approximates an air-plied yarn from two ends of textured, continuous filaments and displays little, if any, slub effect. The thus-formed yarn will process more easily through subsequent knitting and weaving operations than "stable" prior art slub-effect yarns since the tendancy of the prior art yarns is to grab and catch on the package and/or eyelet guides as they pass through the processing machinery.

Optimally, the slub effect of the present invention will be formed in the last processing step before the yarn is made into fabric. The latent slubbing effect may be accomplished by alternately tensioning and releasing one textured end relative to the second end and intermingling the filaments of the two ends during this alternatingly tensioned and released condition sufficiently to substantially interlace the two yarns at spaced intervals, while the remainder between spaced intervals is interlaced sufficiently to form a cohesive yarn but the individual ends will slip relative to each other along their lengths.

The invention may be more fully described with reference to the following Figures:

DETAILED DESCRIPTION OF THE DRAWINGS

Figure 1:
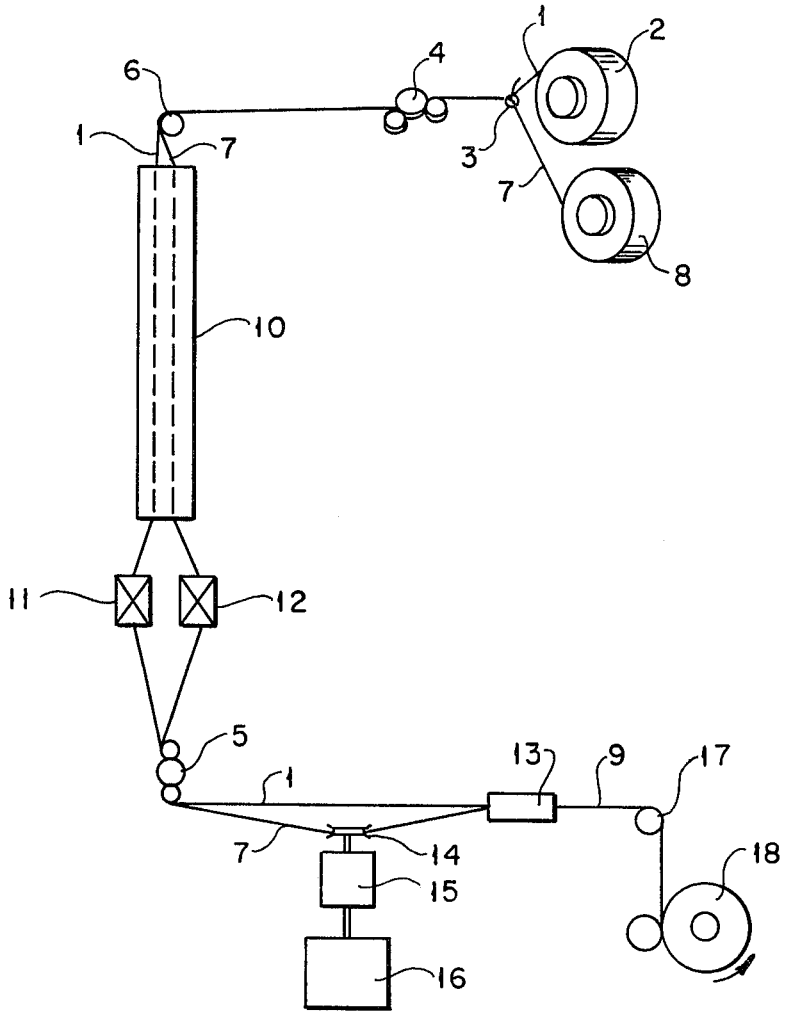
FIG. 1 schematically represents a process for manufacturing an effect yarn according to the invention.

In the manufacture of the effect yarn of this invention as depicted in FIG. 1, continuous filament yarn 1 and continuous filament yarn 7 are withdrawn through an eyelet guide 3 from feeder packages 2 and 8 respectively by a roller means 4. The two yarns are withdrawn further by a roller means 5, which may be operating at a faster relative speed to roller means 4, depending on the degree of prior orientation of the yarns.

Between rollers 4 and 5, the yarns 1 and 7 pass over a guide 6 and through a heater means 10 where the yarns entrap twist caused by falsetwist devices 11 and 12. The yarns 1 and 7 are cooled in accordance with conventional falsetwist techniques, each forming a so-called "lively" yarn since the yarns tend to contract because of the torque twist now engrained in them from the falsetwist process.

The two yarns are withdrawn from roller means 5 to a winding zone 18. From roller 5, yarn 1 will pass through an air or gas tangling jet device 13. Yarn 7 is diverted through movable tension discs 14 before entering the tangling jet device 13 where the two yarns become entangled into a combined yarn 9 prior to passing over guide 17 en route to the winding zone 18.

Tangling jet 13 preferably directs the main exhaust gases in the direction opposite the direction of movement of the yarn. The amount of air pressure and volume of air will, of course, depend on the characteristics of the jet design, the size of the two yarns and the amount of entanglement required and will be known within experimental range by those skilled in the art.

The tension discs 14 are made of suitable material to withstand abrasion and are attractable to each other through magnetic means which are controlled by pulses from electromagnet 15. The electromagnet pulses are signals generated through an electroimpulse controller 16. The electroimpulse signals may be of determined length or amplitude to alternately tension and release yarn 7 as it passes between the discs 14. Randomized signaling will create random appearing slubs. Moreover, through analysis of the fabric structure the effect yarn will be formed into, a defined slub pattern may be designed by appropriate signal generation through computer and/or microprocessor capabilities within the controller 16.

Figure 2:
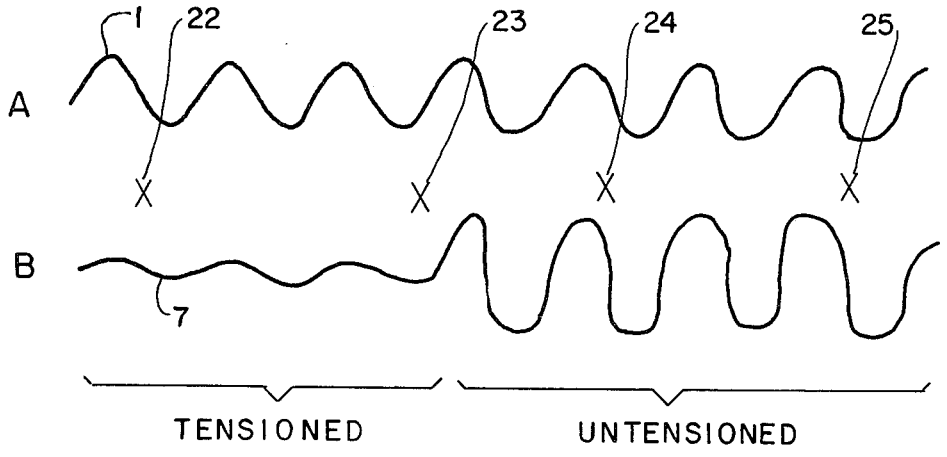
FIG. 2 is a schematic representation of the effect yarn.

The yarn reference numbers have been carried forward consistently in the Figures herein. The yarns 1 and 7 are schematically depicted by line sections A and B in FIG. 2. The amplitude of yarn 1 in A is representative of the texture amplitude of the yarn as it passes under a determined tension through the tangling jet and is shown as relatively constant. Yarn 7 depicted in B shows alternatingly low and high amplitude characteristics as it is tensioned and released (untensioned) through discs 14. Reference numerals 22, 23, 24 and 25 are representative zones of entanglement.

As the two yarns 1 and 7 are passed through the process of FIG. 1 at approximately the same speed, there is essentially zero net overfeed between the two yarns. For any given length of combined yarn 9, therefore, the lengths of the two yarns will be approximately equal. It can be seen, however, that the relative distances along the filament lengths between entanglement points will vary with the relative amplitude of yarn 7. Moreover, the filaments of yarn 7 when tensioned will form a cohesive bundle. The filaments of yarn 1 will wrap around yarn 7, but little wrapping of the yarn 7 filaments about yarn 1 appears to occur when in the tensioned condition.

The section of yarn 1 cohesively intermingled with the tensioned section of yarn 7 thus appears to be able to move linearly or along the length of yarn 7, but has some impediment in the "undeveloped" state because of its being tacked along the length at points 22 and 23 where yarn 7 filaments have sufficiently intermingled with yarn 1 filaments.

It can be seen that adequate intermingling of filaments of both yarns 1 and 7 may take place at representative points 24 and 25 as both groups of filaments are in a state of low tension, thus permitting more interfilamentary movement. Since the yarn 7 between the tension disc 14 and air tangling jet 13 will be extended due to tensioning; and, further, since the yarn 7 is being fed at a constant rate, tension will be reduced upstream of the tension disc. As the yarn 7 has a lively torque, the additional slack in the yarn will be absorbed and no slub will be formed. The yarn 7 above the activated tension disc will be of a higher amplitude (bulkier) going to the tangling jet 13 upon deactivation of tension disc 14. The combined yarn 9 is wound into package form with slubs in an undeveloped state for further processing, and remains as such until sufficient frictional forces are exerted through guides or other means in the later processing to break the resistance to linear movement at tack points 22 and 23. With such occurrence, yarn 1 moves along yarn 7, gathering at a point along yarn 7 where sufficient interfrictional forces of the filaments cause a binding action to thus form a relative large slub.

Figure 3A:
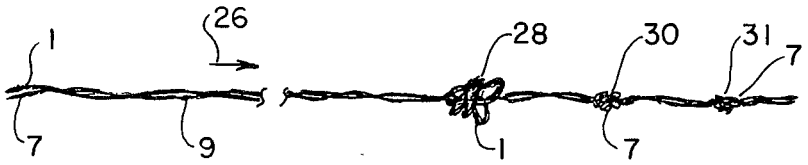
FIG. 3A and FIG. 3B depict slub movement.

As shown in FIG. 3A, adequate frictional forces in the direction of arrow 26 has forced yarn 1 to accumulate into a slub 28 of relatively large size. Smaller slubs 30 and 31 have formed at entanglements 24 and 25 due to a more limited movement of yarn 7 along yarn 1 between the entanglements.

Figure 3B:
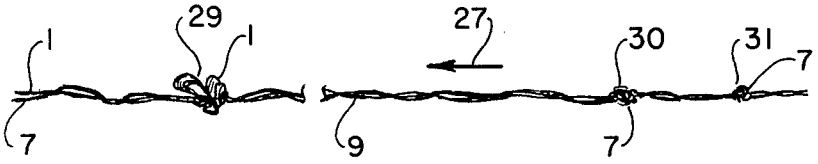

It has been observed that frictional engagement of the combined yarn 9 shown in FIG. 3A in the opposite direction as shown by arrow 27 in FIG. 3B will pull out the slub 28, but reform a slub 29 in that direction upon the buildup of adequate interfilament frictional forces. While the slub will thus move from position to position under the influence of frictional force, such frictional force is essentially unidirectional in knitting and weaving operations. Further, the slub will be locked into place in the formed fabric construction.

Figure 4A:
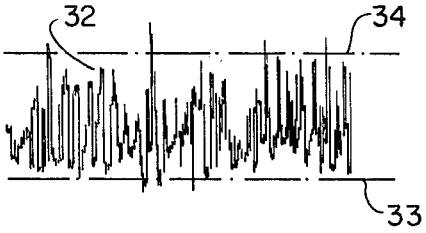
FIG. 4A and FIG. 4B depict representative line graphs of running tensions of the "undeveloped" and "developed" yarn respectively of the invention.

FIG. 4A represents a line graph of relative tensions, as measured through a Rothschild Type R1092 electronic tensiometer, of an undeveloped yarn according to the invention herein. Line 33 represents a minimal mean level of tension in grams as depicted by graph line 32. Line 34 represents a maximum mean level of tension for the undeveloped yarn.

Figure 4B:
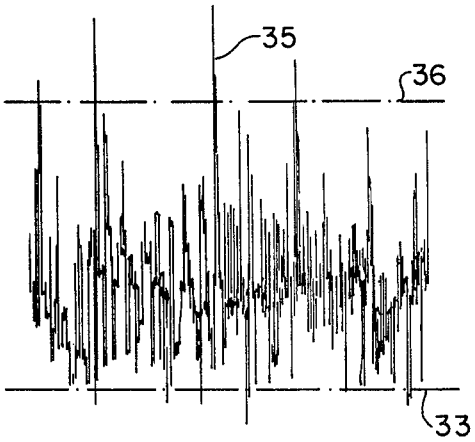

FIG. 4B represents an equivalent line graph of a developed yarn according to the invention. It can be seen that the minimal mean level of tension between FIG. 4A and FIG. 4B is approximately the same. However, the maximum mean level of tension for graph line 35 is much higher—reflecting a greater tendency of the developed yarn to snag, as occurs with known slub-effect yarns.

EXAMPLE 1

Two ends of 170 denier, 32 filament polyester continuous filament yarns were combined according to the process of FIG. 1. The resultant yarn has the following properties:

Denier—350
Tenacity—2.87 gpd
Elongation—21.6%
Boiling Water Shrinkage—3.4%
Hot Air Shrinkage—7.5%
Unevenness—14.5%
Cohesion—64 tangles/meter

EXAMPLE 2

The yarn of Example 1 was unwound through a tensiometer device at a speed of 100 yarns per minute with a scale read out of 0–10 grams. The line graph output was as shown in FIG. 4A. The minimum mean level of tension 33 was recorded as 1.8 grams, and the maximum mean level of tension 34 was recorded as 3.6 grams.

EXAMPLE 3

The combined yarn of Example 1 was run through a frictional device adequate to develop slubs as shown in FIG. 3B. The resulting yarn was unwound as in Example 2 with a line graph output as shown in FIG. 4B. The minimum mean level of tension 33 was recorded as 1.9 grams. The maximum mean level of tension 35 was recorded as 5.8 grams.

EXAMPLE 4

The undeveloped yarn of Example 2 was passed through a Model DT201 fray counter manufactured by Toray Industries, Inc., of Tokyo, Japan. The developed yarn of Example 3 was also passed through the fray counter for comparison at different levels of slub size. The following results in slubs per meter were recorded:

TABLE 1

| | Undeveloped | | | Developed | | | |
|---|---|---|---|---|---|---|---|
| Sample | 1.5mm | 2.00mm | (A) 2.5mm | (B) 2.5mm | 3.50mm | 4.00mm | B:A |
| 94 | 2.64 | 0.3 | 0.046 | 1.38 | 0.22 | 0.0466 | 30 |
| 95 | 4.2 | 0.62 | 0.146 | 4.48 | 0.74 | 0.40 | 30.68 |
| 96 | 8.56 | 0.7 | 0.10 | 2.9 | 0.66 | 0.28 | 29 |
| 97 | 8.6 | 1.0 | 0.18 | 4.18 | 1.28 | 0.58 | 23.22 |

TABLE 1-continued

| | Undeveloped | | | Developed | | | |
|---|---|---|---|---|---|---|---|
| Sample | 1.5mm | 2.00mm | (A) 2.5mm | (B) 2.5mm | 3.50mm | 4.00mm | B:A |
| 98 | 6.04 | 0.6 | 0.14 | 5.66 | 1.48 | 0.82 | 40.42 |
| 99 | 6.06 | 0.72 | 0.14 | 2.62 | 0.54 | 0.42 | 18.7 |
| 100 | 4.4 | 0.6 | 0.12 | 3.5 | 0.80 | 0.40 | 29.16 |
| 101 | 6.56 | 1.0 | 0.28 | 7.52 | 1.74 | 1.00 | 26.86 |
| 102 | 4.2 | 0.38 | 0.052 | 3.96 | 0.70 | 0.72 | 76.15 |
| 103 | 5.3 | 0.52 | 0.072 | 4.84 | 1.38 | 0.96 | 67.22 |
| 104 | 4.98 | 0.70 | 0.115 | 2.84 | 0.64 | 0.38 | 24.69 |
| 105 | 5.24 | 0.70 | 0.132 | 4.16 | 1.10 | 0.56 | 31.5 |
| 106 | 3.74 | 0.40 | 0.066 | 2.66 | 0.52 | 0.36 | 40.3 |
| 107 | 5.08 | 0.56 | 0.14 | 3.44 | 0.64 | 0.36 | 24.57 |

It has been observed that the slub size is directly affected by the tension of the discs 14. Too high tension will cause breakage of the yarn or loss of adequate tangle. Further, the hold time affects slub formation. The longer the hold time, the greater the tension buildup in yarn 7. Overfeed of the combined yarn from roller 5 to the winding zone also affects slub formation, too much overfeed resulting in choking of the tangle jet.

What is claimed is:

1. A two-phase effect yarn, comprising a first group of lively textured synthetic polymeric continuous filaments and a second group of textured synthetic polymeric filaments, the two groups of filaments being of substantially equal length and combined along their lengths to form a cohesive yarn, and further, slidably attached to each other along portions of their combined lengths, the first group of filaments having alternatingly low and high amplitude characteristics relative to the second group, but substantially no formed slubs along the combined yarn length in a first phase; slubs being capable of being formed in a second phase by exerting sufficient frictional forces along the length of the combined yarn in one direction to cause the two groups of filaments to slide relative to each other until sufficient interfilamentary frictional forces cause a binding action among the filaments.

2. A process for manufacturing an effect yarn, comprising the steps of feeding a first group of lively textured synthetic polymeric continuous filaments at substantially the same rate from a supply zone to an air entangling zone, passing the first group of filaments through a tensioning zone prior to said entangling zone, alternatingly tensioning and releasing the first group of filaments in said tensioning zone, directing the main exhaust gases from an air entangling jet in the entangling zone opposite the direction of movement of filaments through the zone, whereby filaments of the first and second groups are cohesively intermingled with sections of said second group of filaments slidable along the length of the first group of filaments.

3. The process of claim 2, wherein the periods of tensioning and release are determined in accordance with a set slub pattern to be formed along the length of the combined yarn.

4. The process of claim 3, wherein the periods of tensioning and release are determined in accordance with a set slub pattern to be formed along the length of the combined yarns for a face pattern effect in a given fabric construction.

5. A fabric containing at least one effect yarn of claim 1.

6. A fabric containing an effect yarn manufactured according to the process of claim 2 or 3.

* * * * *